US006755165B2

(12) United States Patent
Kondou et al.

(10) Patent No.: US 6,755,165 B2
(45) Date of Patent: Jun. 29, 2004

(54) VALVE CONTROL APPARATUS AND METHOD FOR INTERNAL COMBUSTION ENGINE

(75) Inventors: Shinya Kondou, Susono (JP); Hiroyasu Koyama, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/373,813

(22) Filed: Feb. 27, 2003

(65) Prior Publication Data

US 2003/0164149 A1 Sep. 4, 2003

(30) Foreign Application Priority Data

Feb. 27, 2002 (JP) ..... 2002-051439

(51) Int. Cl.[7] ..... F01L 1/34

(52) U.S. Cl. ..... 123/90.17; 123/90.16; 123/90.15

(58) Field of Search ..... 123/90.31, 90.11–90.18

(56) References Cited

U.S. PATENT DOCUMENTS

| | | | | |
|---|---|---|---|---|
| 5,333,577 A | * | 8/1994 | Shinojima | 123/90.15 |
| 5,363,817 A | | 11/1994 | Ikeda et al. | 123/90.15 |
| 5,400,747 A | | 3/1995 | Tabata et al. | 123/90.17 |
| 5,562,071 A | * | 10/1996 | Urushihata et al. | 123/90.15 |
| 5,680,834 A | * | 10/1997 | Szpak et al. | 123/90.15 |
| 6,032,623 A | | 3/2000 | Yamagishi et al. | 123/90.17 |
| 6,257,184 B1 | | 7/2001 | Yamagishi et al. | 123/90.15 |
| 6,516,759 B2 | * | 2/2003 | Takahashi et al. | 123/90.15 |
| 2001/0013324 A1 | | 8/2001 | Yoshizawa et al. | 123/90.16 |

FOREIGN PATENT DOCUMENTS

| | | |
|---|---|---|
| DM | 1 052 378 A2 | 4/2000 |
| JP | A 8-193591 | 7/1996 |

OTHER PUBLICATIONS

Toyota Technical Report No. 9555, Jun. 30, 1999.

* cited by examiner

*Primary Examiner*—Thomas Denion
*Assistant Examiner*—Kyle Riddle
(74) *Attorney, Agent, or Firm*—Oliff & Berridge, PLC

(57) ABSTRACT

The invention controls the opening of an oil control valve (OCV), which controls the operation of a variable valve timing mechanism in an internal combustion engine, according to a duty ratio of a driving pulse signal. An electronic control unit (ECU) performs feedback control on a duty ratio DR of the driving pulse signal during ordinary operation based on a target value and an actual value of the valve timing. When the oil temperature is low (i.e., when the operating oil viscosity is high), the ECU controls the valve timing of the engine by repeating an inching operation that maintains the duty ratio DR of the signal at a large value (i.e., 0% or 100%) for a predetermined hold time so as to operate the variable valve timing mechanism, and then maintaining the duty ratio DR of the signal at a value (50%) that does not operate the variable valve timing mechanism.

16 Claims, 11 Drawing Sheets

VALVE CONTROL APPARATUS AND METHOD FOR INTERNAL COMBUSTION ENGINE

INCORPORATION BY REFERENCE

The disclosure of Japanese Patent Application No. 2002-051439 filed on Feb. 27, 2002, including its specification, drawings and abstract, is incorporated herein by reference in its entirety.

BACKGROUND OF THE INVENTION

1. Field of the Invention

The invention relates to a valve control apparatus and method for an internal combustion engine. More particularly, the invention relates to a valve control apparatus and method provided with means for changing a valve operating characteristic such as valve opening timing (i.e., valve timing), valve lift amount, and open valve period of one or both of an intake valve and an exhaust valve in each cylinder of an internal combustion engine.

2. Description of the Related Art

A valve control apparatus for an internal combustion engine is known that changes an operating characteristic of one or both of an intake valve and an exhaust valve of the internal combustion engine while it is running, so as to enable constant optimal engine performance regardless of the running state of the engine. One known example of this type of valve control apparatus controls one or more of a valve opening and closing timing (i.e., valve timing), a valve lift amount, and an open valve period, and the like of an intake valve and an exhaust valve according to the operating state of the internal combustion engine.

When changing the valve timing, for example, a method is used that changes a relative rotation phase of a camshaft with respect to a crankshaft using a hydraulic actuator or the like. Further, to change the valve lift amount, the open valve period and the like, various methods are used. One method aligns a plurality of cams having profiles with different cam lift amounts and cam operation angles in the axial direction on a camshaft, and switches the cam that drives the valve by moving the camshaft in the axial direction using a hydraulic actuator. Another method changes the valve lift amount and open valve period by providing a cam having a cam profile with a continuous change in the actuation angle and the like, instead of providing a plurality of cams, and moving the camshaft in the axial direction using a hydraulic actuator.

An example of this type of valve control apparatus is disclosed in Japanese Patent Laid-Open Publication No. 6-159021, for example.

The valve control apparatus in the foregoing publication controls the valve timing of an intake valve to an optimal value according to the operating state of the engine. This valve control apparatus is provided with a hydraulic actuator that rotates the camshaft relative to the crankshaft, and an oil control valve able to supply an oil pressure that actuates the hydraulic actuator in a direction to advance the valve timing and an oil pressure that actuates the hydraulic actuator in a direction to retard the valve timing.

Also, the valve control apparatus in the foregoing publication is provided with a cam position sensor that detects a rotation phase difference between the camshaft and the crankshaft. The valve control apparatus calculates the actual valve timing using the cam position detected by the sensor, obtains the difference between a target valve timing set from the operating state of the engine and the actual valve timing that was calculated, and performs feedback control on the oil control valve based on this difference.

For example, this feedback control is made PID control based on the difference, and the opening of the oil control valve is set as the sum of the difference and the components proportional to an integral value and a derivative value of the difference.

According to the apparatus in the publication, the proportional coefficient (i.e., gain) of each of the components of the PID control is set according to the engine speed. Ordinarily, because the oil pressure supplied to the actuator is supplied by an oil pump that is driven by the engine, the discharge pressure of the pump changes according to the engine speed. Therefore, if the gain of each of the components of the PID control are fixed, the response rate of the control may change according to a change in the pump discharge pressure (i.e., the engine speed). Therefore, because the output of the apparatus and the gain of each of the components of the PID control in the foregoing publication are not fixed, but set according to the engine speed, the pressure and amount of oil supplied to the hydraulic actuator can be controlled based on the ability (i.e., discharge pressure, discharge amount) of the engine driven oil pump. Accordingly, consistently stable valve timing control is able to be performed regardless of the engine speed.

By setting the gain of the PID control according to the engine speed, the apparatus disclosed in the aforementioned publication prevents the operation speed of the hydraulic actuator from decreasing by setting the gain large in the low speed region, in which the discharge pressure and discharge amount of the engine driven oil pump decrease, and prevents overshooting and hunting in the control by setting the gain low when the engine is running at high speeds, for example.

With the apparatus disclosed in Japanese Patent Laid-Open Publication No. 6-159021, however, even though control is performed according to the engine speed, there are times, such as when the oil temperature is low when the engine is cold, when the valve operating characteristic is unable to be controlled appropriately.

At times such as when the engine is running but is cold after starting, the temperature of the operating oil supplied to the hydraulic actuator has not risen sufficiently so the viscosity of that operating oil is high. Accordingly, an increase in flow resistance within the oil passages and an increase in friction resistance of the sliding portions, and the like, reduce the operating speed of the hydraulic actuator, thereby lowering the responsiveness in the control over the valve operating characteristic and narrowing the operating range of the hydraulic actuator.

The apparatus in the aforementioned publication compensates for the decrease in oil pressure and oil amount when the engine is running at low speeds by increasing the control gain. However, hydraulic systems and engine driven oil pumps and the like are ordinarily designed so that the discharge pressure and the discharge amount will not change much when the engine speed changes, so changes in the oil pressure and oil amount due to changes in the engine speed are kept comparatively small. In contrast, there are times when the increase in flow resistance and the increase in friction resistance due to increased oil viscosity at low temperatures may become far greater than the increase in flow resistance and the increase in friction resistance due to a change in the engine speed.

Therefore, when attempting to prevent a decrease in control responsiveness by only increasing the control gain when the oil temperature is low, there is a tendency for the increase in the gain to become quite large, which may result in overshooting or hunting or the like, making control unstable. Also, the deterioration in the control accuracy of the actuator due to the increased oil viscosity cannot be corrected by just increasing the gain. Just increasing the gain when the oil temperature is low results in the control becoming unstable, which in turn results in a delay in reaching the target valve operating characteristic, and the like, which ultimately leads to a deterioration in engine performance at low temperatures and a deterioration in the exhaust gas emissions, and the like.

SUMMARY OF THE INVENTION

In view of the foregoing problems, it is an object of the invention to provide a valve control apparatus and method that enables the responsiveness in valve control to be improved without losing stability in the control, even when the engine is cold.

According to a first aspect of the invention, a valve control apparatus is provided which changes a valve operating characteristic of an internal combustion engine, the valve operating characteristic including at least one of a valve timing, a valve lift amount, and an open valve period. The valve control apparatus includes a actuator that changes the valve operating characteristic. This actuator is actuated according to a value of a driving signal that is input thereto. The valve control apparatus also includes a controller that detects an operating characteristic parameter indicative of the valve operating characteristic and outputs a driving signal value according to a difference between an operating characteristic target value according to an operating condition of the engine and the detected parameter value to the actuating means. The controller performs a forced driving operation that repeats an operation for maintaining the driving signal at a predetermined forced driving signal value for a predetermined hold time when the difference is greater than a predetermined value.

That is, according to the first aspect, when the feedback control is performed on the actuator based on a difference between a control target value and an actual value for a valve operating characteristic parameter and that difference is large, the value of the driving signal is not determined based on the size of that difference, as it is with the conventional feedback control. Instead, the driving signal is set to an appropriate value and an operation which maintains that driving signal value at this value (i.e., a forced driving signal value) for a certain period of time is repeatedly performed. That is, the amount of change in the valve operating characteristic is controlled by increasing or decreasing the number of times the operation is repeated.

As described earlier, at times when the viscosity of the operating fluid is high, such as when the engine is cold, in order to obtain good response to the valve operating characteristic, it is necessary to greatly increase the gain of the feedback control. If the control gain is greatly increased and the difference between the control target value and the actual value is large, however, the value of the driving signal also increases accordingly, which may result in overshooting or hunting, which may cause a delay in reaching the target value. According to this invention, because the forced driving operation that intermittently maintains, or holds, the driving signal value at a large value only when the difference is large is performed without the gain of the feedback control being increased, the value of the driving signal returns to a comparatively small value each time the hold time elapses. As a result, it is possible to increase the overall operation speed of the actuating means while minimizing overshooting and hunting.

The forced drive signal value does not need to be a fixed value throughout the forced driving operation. It may be any value as long as it is able to reliably change the valve operating characteristic. Further, the forced driving signal value does not need to be maintained at a fixed value throughout one hold time. It may be a value that changes during one hold time as long as it is within a range of a size able to reliably change the valve operating characteristic.

It is preferable that the forced driving signal value be set to a comparatively large value (e.g., a value which will result in the greatest operating speed of the actuator) able to operate the actuator even when the operating range of the actuator is narrow, such as when the temperature is low.

According to a second aspect of the invention, a valve control method for an internal combustion engine having an actuator that changes a valve operating characteristic is provided. The actuator is actuated according to a value of a driving signal that is input thereto. The valve operating characteristic includes at least one of a valve timing, a valve lift amount, and an open valve period. This control method comprises the steps of: detecting an operating characteristic parameter indicative of the valve operating characteristic; outputting the driving signal value according to a difference between an operating characteristic target value according to an operating condition of the engine and the detected parameter value to the actuator. In this control method, a forced driving operation that repeats an operation to maintain the driving signal at a predetermined forced driving signal value for a predetermined hold time is performed when the difference is greater than a predetermined value.

DETAILED DESCRIPTION OF THE PREFERRED EMBODIMENTS

An exemplary embodiment according to the invention will hereinafter be described with reference to the appended drawings.

Figure 1:
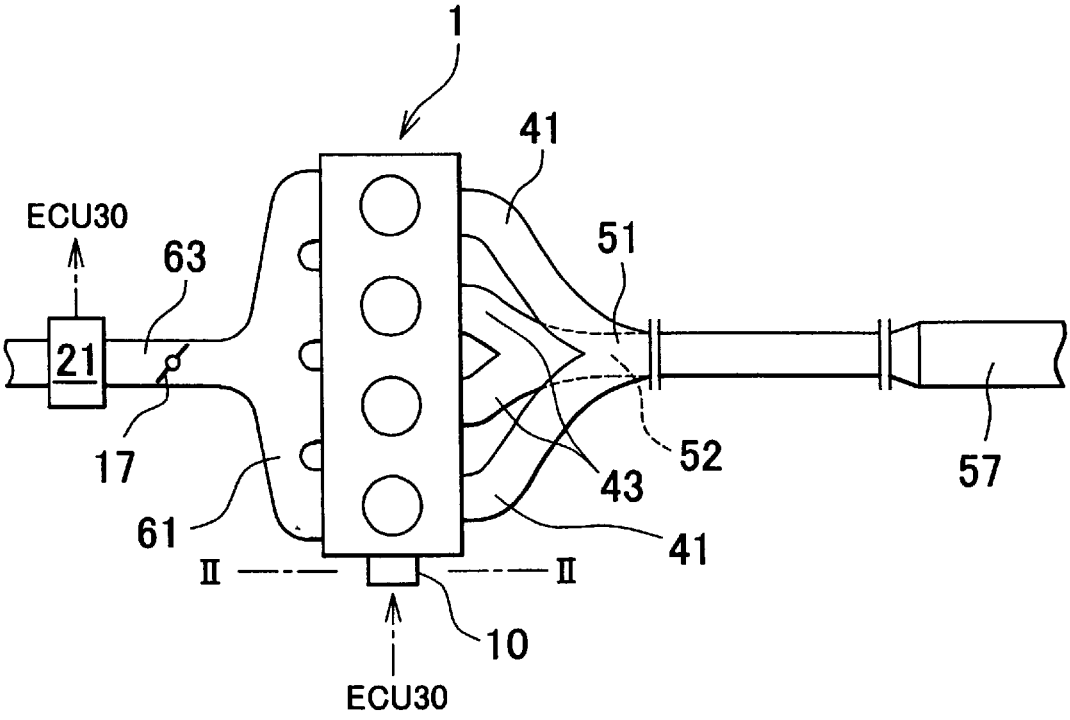
FIG. 1 is a block diagram schematically showing an embodiment of the invention in which a valve timing control apparatus according to the invention has been applied to an internal combustion engine of an automobile.

FIG. 1 is a view schematically showing an exemplary embodiment in which a valve control apparatus according to the invention has been applied to a four cylinder internal combustion engine of an automobile.

FIG. 1 shows an internal combustion engine 1 of an automobile. According to this exemplary embodiment, the engine 1 is a DOHC (double overhead camshaft) type four cylinder engine having an intake camshaft and an exhaust camshaft which are independent of each other. The exhaust system of the engine 1 in the exemplary embodiment is a so-called duel exhaust system, in which two cylinders that fire in a sequence, such that the discharging of exhaust from one does not interfere with the discharging of exhaust from the other, are connected to a single exhaust passage. FIG. 1 shows an exhaust branch pipe 41, which merges the exhaust from a first cylinder and a third cylinder into an exhaust assembly pipe 51, and an exhaust branch pipe 43, which merges the exhaust from a second cylinder and a fourth cylinder into a exhaust assembly pipe 52. Further, the exhaust assembly pipe 51 and an exhaust assembly pipe 52 join together into a single exhaust pipe 57 on the downstream side.

In FIG. 1, an intake manifold 61 connects each cylinder of the engine 1 to a common intake passage 63, in which is provided a throttle valve 17. An airflow meter 21 that outputs a signal indicative of an engine intake air amount is also provided in the intake passage 63.

Also according to the exemplary embodiment, a valve control apparatus that controls an operating characteristic of the valves in each cylinder is provided in the engine 1.

In the exemplary embodiment, a so-called variable valve timing mechanism 10, which controls the opening and closing timing of the valves, is used as the valve control apparatus. That is, although the exemplary embodiment as described below changes the valve timing of the intake valve as a valve operating characteristic of the engine 1, the invention can also be used to change a valve operating characteristic other than the valve timing, such as the valve lift amount or the open valve period, of the intake valve and exhaust valve.

Hereinafter, the structure of the variable valve timing mechanism of the exemplary embodiment will briefly be described with reference to FIGS. 2 and 3.

Figure 2:
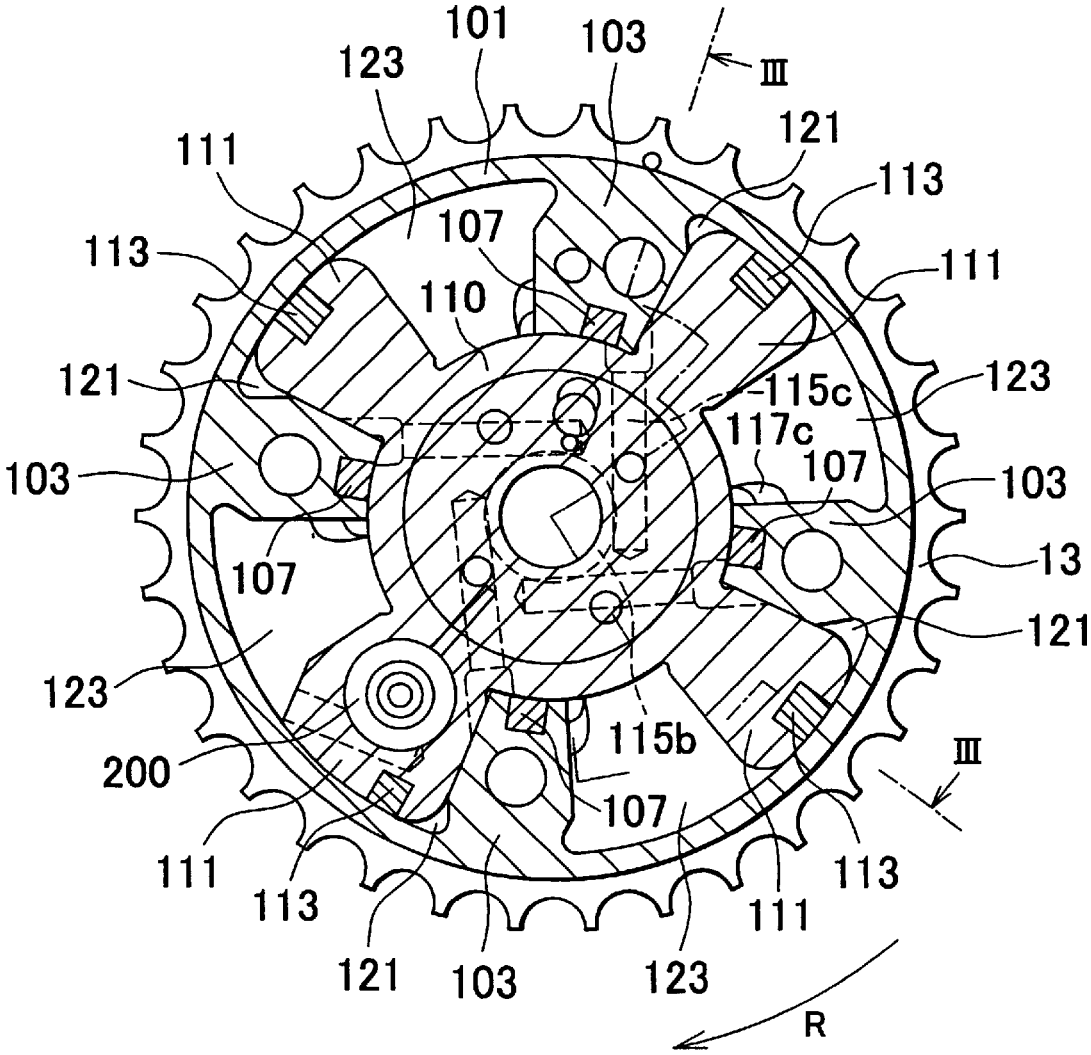
FIG. 2 is a view schematically illustrating the construction of a variable valve timing mechanism as one example of the valve control apparatus.

FIG. 2 is a cross-section view of a variable valve timing mechanism 10 according to the exemplary embodiment, taken along line II—II in FIG. 1. FIG. 3 is a cross-section view taken along line III—III in FIG. 2.

Figure 3:
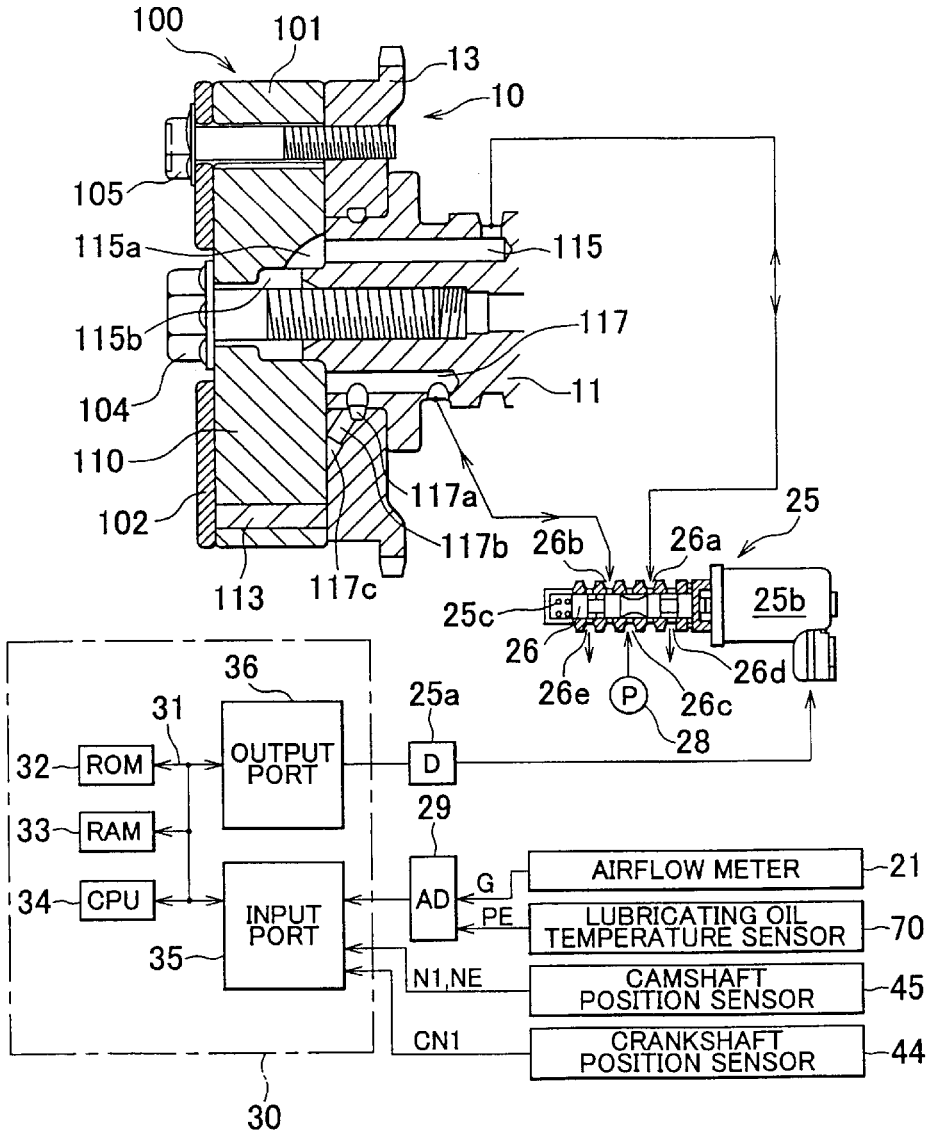
FIG. 3 is another view schematically illustrating the construction of the variable valve timing mechanism shown in FIG. 2 as one example of the valve control apparatus.

FIGS. 2 and 3 show a timing pulley 13 rotatably driven by a crankshaft, not shown, using a chain, a spacer 101 that serves as a dividing wall, to be described later, and an end cover 102. The timing pulley 13, spacer 101, and end cover 102 are integrally fastened together with a bolt 105, so as to comprise a housing 100 that rotates together with the timing pulley 13. Further, in FIGS. 2 and 3, a vane body 110 is rotatably housed within the housing 100. This vane body 110 is connected by a bolt 104 to an intake camshaft 11 that opens and closes an intake valve, not shown, of each cylinder in the engine 1, and rotates together with the housing 100. That is, driving force for the intake camshaft 11 is transmitted from the crankshaft to the timing pulley 13 and the housing 100 by the chain, and then from the housing 100 to the intake camshaft 11 through the vane body 110.

As shown in FIG. 2, the vane body 110 is provided with a vane 111 on its outer peripheral portion, and the spacer 101 of the housing 100 is provided with a dividing wall 103 formed extending radially toward the inside (in the exemplary embodiment, there are four vanes 111 and four dividing walls 103). As can be seen in FIG. 2, the dividing walls 103 divide the inside of the housing 100 into sections. The vanes 111 further divide each of these sections into two oil chambers 121 and 123. Also, each sliding portion between the housing 100 and the vane body 110 are kept oil tight by oil seals 107 and 113 and the like. According to this exemplary embodiment, the intake valve timing is changed by supplying operating oil (engine lubricating oil in this embodiment) to one of the oil chambers 121 and 123 and discharging operating oil from the other so as to rotate the vane body 110 relative to the housing 100 when the engine is running.

For example, if the direction of rotation of the timing pulley 13 is that shown by arrow R in FIG. 2, supplying operating oil to the oil chamber 121 and discharging operating oil from the oil chamber 123 displaces the vane body 110 with respect to housing 100 in the direction of arrow R. Because the housing 100 and the timing pulley 13 are rotating in sync with the crankshaft, the vane body 110 and the intake camshaft 11, which is connected to the vane body 110, rotate integrally with the housing 100 with the rotation phase advanced in the direction of arrow R with respect to the crankshaft. As a result, the intake camshaft 11 is kept, by hydraulic pressure within the oil chambers 121 and 123, in a position in which the rotation phase is advanced with respect to the crankshaft, such that the intake valve timing advances. Also, conversely, supplying operating oil to the oil chamber 123 and discharging operating oil from the oil chamber 121 retards the intake valve timing. Therefore, for the sake of convenience in this specification, the oil chamber 121 shall be referred to as the "advancing oil chamber," and the oil chamber 123 will be referred to as the "retarding oil chamber."

Further, according to the exemplary embodiment, a lock pin 200 is provided for fixing the vane body 110 in a predetermined position with respect to the housing 100. This lock pin 200 locks the housing 100 and the vane body 110 together when hydraulic pressure is not able to be obtained, for example, such as during engine startup, thereby inhibiting the valve timing from changing.

As shown in FIG. 3, an oil passage 115 which supplies operating oil to the oil chamber 121, and an oil passage 117 which supplies operating oil to the oil chamber 123 are provided. The operating oil supplied to the oil chamber 121 flows from a circular oil groove, not shown, provided at an inner periphery of a bearing of the intake camshaft 11, into the oil passage 115 which is bored in the axial direction in the intake camshaft 11. The operating oil then flows through a notch 115*a* in the vane body 110 and into an annular oil groove 115*b* formed inside the vane body 110. The operating oil then flows from this annular oil groove 115*b*, through an oil passage 115*c* (FIG. 2), and into the oil chamber 121 from the base of the vane 111 of the vane body 110. Also, the operating oil supplied to the oil chamber 123 flows from another circular oil groove provided in the intake camshaft 11 into the oil passage 117 which is bored in the axial direction in the intake camshaft 11. The operating oil then flows from a peripheral groove 117*a* formed in a sliding portion between the intake camshaft 11 and the timing pulley 13, through an oil passage 117*b* in the timing pulley 13, and out from a port 117*c* into the oil chamber 123.

FIG. 3 shows an oil control valve (hereinafter, referred to as an "OCV") 25 that controls the supply of operating oil to the oil chambers 121 and 123. In this exemplary embodiment, the OCV 25 corresponds to the housing 100 and the vane body 110, as well as actuating means of this invention.

The OCV 25 according to this exemplary embodiment is a spool valve which has a spool 26 and includes an oil port 26*a* connected to the oil passage 115 via a pipe, an oil port 26*b* connected to the oil passage 117 via a pipe, a port 26*c* connected to an oil supply source 28 such as a lubricating oil pump that is driven by the output shaft of the engine, and two drain ports 26*d* and 26*e*. The spool 26 of the OCV 25 operates so as to communicate the port 26*c* with either the oil port 26*a* or the oil port 26*b*, and connects the other with the corresponding drain port.

That is, when the spool 26 moves to the right from a neutral position shown in FIG. 3, the oil port 26*a* that is communicated to the oil passage 115 is opened according to the amount of movement of the spool 26 so as to become connected with the oil supply source 28 via the port 26*c*, while the drain port 26*d* gradually closes according to the amount of movement. Further, at the same time, the oil port 26*b*, which is connected to the oil passage 117, is opened according to the amount of movement of the spool 26 so as to gradually become communicated with the drain port 26*e*. Therefore, operating oil from the oil supply source 28 such as a lubricating oil pump of an engine flows into the oil chamber 121 of the variable valve timing mechanism 10, thereby increasing the hydraulic pressure within the oil chamber 121 and pushing the vane body 110 in the direction of arrow R (i.e., in the advance direction) in FIG. 2. Also at this time, the operating oil within the oil chamber 123 is discharged through the oil port 26*b* and the like of the OCV 25 and out the drain port 26*e*.

Accordingly, the vane body 110 rotates with respect to the housing 100 in the R direction in FIG. 2. Because the open area of the oil port 26*a* and the open area of the drain port 26*e* increase according to the amount of movement of the spool to the right, the hydraulic pressure acting inside of the oil chamber 121 also increases according to the amount of movement of the spool to the right. Therefore, the rotation speed (i.e., advance rate) of the vane body 110 increases according to the amount of movement of the spool.

Also, conversely, if the spool 26 is moved to the left from the neutral position in FIG. 3, the oil port 26*b* becomes connected with the oil supply source 28 via the port 26*c* and the oil port 26*a* becomes connected with the drain port 26*d*. Accordingly, operating oil flows into the oil chamber 123 through the oil passage 117 and is discharged from the oil chamber 121 through the oil passage 115 out the drain port 26*d*. As a result, the vane body 110 rotates with respect to the housing 100 in the direction opposite that of arrow R in FIG. 2. In this case as well, the rotation speed (i.e., retard rate) of the vane body 110 increases according to the amount of movement (to the left in the figure) of the spool.

Further, when the spool 26 is in the neutral position shown in FIG. 3, both the oil port 26*a* and the oil port 26*b* are closed. Accordingly, when the spool is in the neutral position, the oil chambers 121 and 123 are sealed and the rotation phase of the vane body 110 with respect to the housing 100 is fixed. As a result, the valve timing of the intake valve is fixed.

As shown in FIG. 3, a linear solenoid actuator 25*b* that drives the spool 26 and a spring 25*c* that energizes the spool 26 in the direction to the right in the figure are provided. The linear solenoid actuator 25*b* receives a control pulse signal from an electronic control unit (ECU) 30, to be described later, and generates a pushing force according to this control pulse signal that pushes the spool 26 against the energizing force of the spring 25*c*, i.e., to the left in FIG. 3.

The position of the spool 26, i.e., the direction and speed of rotation of the vane body 110 (i.e., the direction and rate of change of the valve timing of the intake valve) are determined by the pushing force generated by the linear solenoid actuator 25*b*. In this exemplary embodiment, the ECU 30 controls the pushing force generated by the linear solenoid actuator 25*b*, i.e., controls the position of the spool 26, by changing the duty ratio of the control pulse signal supplied to the linear solenoid actuator 25*b*. Here, the duty ratio DR of the control pulse signal is defined as the amount (i.e., percentage) of time the pulse is on with respect to the total time that the pulse is both on and off (i.e., one cycle).

The force from the linear solenoid actuator 25*b* pushing the spool 26 to the left in the figure increases the larger the control pulse duty ratio DR defined above becomes. According to the exemplary embodiment, when the duty ratio DR is 50%, the pushing force of the linear solenoid actuator 25*b* and the energizing force of the spring 25*c* are set so that they are balanced at the neutral position in FIG. 3. Also, when the duty ratio DR becomes greater than 50%, the pushing force by the linear solenoid actuator 25*b* increases such that it balances with the energizing force of the spring 25*c* at a position to the left of the neutral position. That is, when the duty ratio is in the region greater than 50%, the spool 26 moves to the left of the neutral position by the amount according to the duty ratio DR. Accordingly, when the duty ratio DR is 100%, the spool 26 moves to the leftmost position in FIG. 3.

Likewise, when the duty ratio is in the region less than 50%, the spool 26 moves to the right of the neutral position by the amount according to the duty ratio DR. Accordingly, when the duty ratio DR is 0%, the spool 26 moves to the rightmost position in FIG. 3.

As described above, when the spool 26 is to the right of the neutral position, the vane body 110 rotates to the advance side, with the rotation speed increasing the farther the spool moves to the right from the neutral position. Further, when the spool 26 is to the left of the neutral position, the vane body 110 rotates to the retard side, with the rotation speed increasing the farther the spool moves to the left from the neutral position.

Accordingly, when the duty ratio DR is in the region less than 50%, the valve timing of the intake valve changes in the direction of advance, with the rate of that change increasing the lower the duty ratio, and the advance rate being greatest when the duty ratio DR is 0%. Also, when the duty ratio DR is in the region above 50%, the valve timing changes to the direction of retard, with the rate of that change increasing the higher the duty ratio, and the retard rate being greatest when the duty ratio DR is 100%. Also, when the duty ratio DR is 50%, the valve timing is fixed, with the rate of change in the valve timing being zero.

As shown in FIG. 3, the ECU 30 is provided which controls the operation of the OCV 25. According to this exemplary embodiment, the ECU 30 is configured as a microcomputer of a well-known configuration that interconnects, via a bi-directional bus 31, read-only memory (ROM) 32, random access memory (RAM) 33, a microprocessor (CPU) 34, an input port 35, and an output port 36. The ECU 30 in this exemplary embodiment adjusts the valve timing of the intake valve by changing the duty ratio of the control pulse signal sent to the linear solenoid actuator 25*b* of the OCV 25 according to engine operating conditions, and sets the valve timing of the intake valve so that it is optimal for those engine operating conditions.

For this control, the input port 35 of the ECU 30 receives, via an AD converter 29, a voltage signal indicative of an intake air amount G from the airflow meter 21 provided in the intake passage 63 of the engine 1, and a voltage signal indicative of a lubricating oil temperature T from a lubricating oil temperature sensor 70 provided in the lubricating oil passage of the engine 1. In addition, the input port 35 of the ECU 30 also receives a pulse signal indicative of a position of the intake camshaft 11 from a camshaft position sensor 45 provided on the camshaft, and a pulse signal indicative of a crankshaft position from a crankshaft position sensor 44 provided on the crankshaft of the engine. Alternatively, however, a coolant temperature sensor that detects a coolant temperature of the engine 1 may be provided instead of the lubricating oil temperature sensor 70, and the lubricating oil temperature T may be estimated from the detected coolant temperature.

The pulse signal from the crankshaft position sensor 44 includes an N1 signal indicative of a reference position of the crankshaft, which is generated every time the crankshaft rotates 720 degrees, and an engine speed NE signal that is generated every time the crankshaft rotates a predetermined number of degrees. The camshaft position sensor 45 generates a CN1 pulse signal which indicates that the camshaft has reached a reference position every time it rotates 360 degrees. The ECU 30 calculates the engine speed NE from the pulse interval of the NE signal at regular intervals of time. The ECU 30 then uses this engine speed NE to calculate the actual rotation phase of the intake camshaft 11 (i.e., the actual valve timing of the intake valve) from the length of the interval between the N1 signal and the CN1 signal. The calculation results are then stored in the RAM 33. Also, the intake air amount G and the lubricating oil temperature T are AD converted at regular intervals of time and also stored in the RAM 33.

Meanwhile, the output port 36 of the ECU 30 is connected via a drive circuit 25*a* to the linear solenoid actuator 25*b* of the OCV 25 and supplies a control signal to the linear solenoid actuator 25*b*. In this exemplary embodiment, the ECU 30 calculates the intake air amount per rotation of the crankshaft of the engine 1, G/NE, from the intake air amount G and the engine speed NE calculated as described above. The ECU 30 then sets the intake valve timing using this G/NE and the engine speed NE as parameters representative of the engine load. That is, the ECU 30 stores the preset optimal intake valve timing in the ROM 32 in the form of a numeric map that uses the G/NE and the engine speed NE. Then, based on this numeric map, the ECU 30 sets the target (i.e., optimal) valve timing using the calculated G/NE and the engine speed NE. The ECU 30 then performs feedback control on the duty ratio of the control signal supplied to the OCV 25 such that the actual valve timing comes to match the target valve timing. This valve timing control operation is PID control based on a difference DVT between the target valve timing and the actual valve timing, for example.

That is, in this exemplary embodiment, the ECU 30 calculates the difference DVT between the target valve timing and the actual valve timing at regular intervals of time. The ECU 30 also calculates the duty ratio DR of the driving signal (i.e., control pulse signal) supplied to the OCV 25 using the following expression.

$$DR=\alpha\times DVT+\beta\times(DVT-DVT_{i-1})+\gamma\times\Sigma DVT$$

In this expression, DVT represents the difference between the target valve timing calculated this time and the actual valve timing, and $DVT_{i-1}$ represents the difference during the DR calculating operation the last time. Further, ΣDVT represents the integrated valve of the difference DVT. In the above expression, α×DVT corresponds to term P (a ratio) in the PID control, λ×ΣDVT corresponds to term I (an integral), $\beta\times(DVT-DVT_{i-1})$ corresponds to term D (an integral), and α, β, and λ are coefficients corresponding to the gains of terms P, I, and D, respectively.

As described above, when performing feedback control based on the difference between the target valve timing and the actual valve timing, it is possible to control the valve timing stably without sacrificing responsiveness, by selecting the optimal gain coefficient.

However, a problem arises when performing this feedback control at low temperatures. When the engine temperature is low, the temperature of the lubricating oil is also low and the viscosity of that lubricating oil is high. Accordingly, the discharge pressure of the lubricating oil pump decreases such that the oil pressure supplied to the OCV 25 also decreases. Further, because of the increase in flow resistance due to the high oil viscosity, the pressure and amount of oil supplied to the oil chambers 121 and 123 of the vane body 110 from the OCV 25 also decreases, resulting in a slower rate of change in the valve timing.

Furthermore, in addition to the decrease in the valve timing change rate (i.e., the response rate of the variable valve timing mechanism) due to the reduced pressure and amount of the oil, when the oil temperature is low, the increase in sliding friction resistance and flow resistance impedes movement of the spool 26 of the OCV 25 such that the spool 26 may no longer move following the change in the duty ratio.

Figure 4:
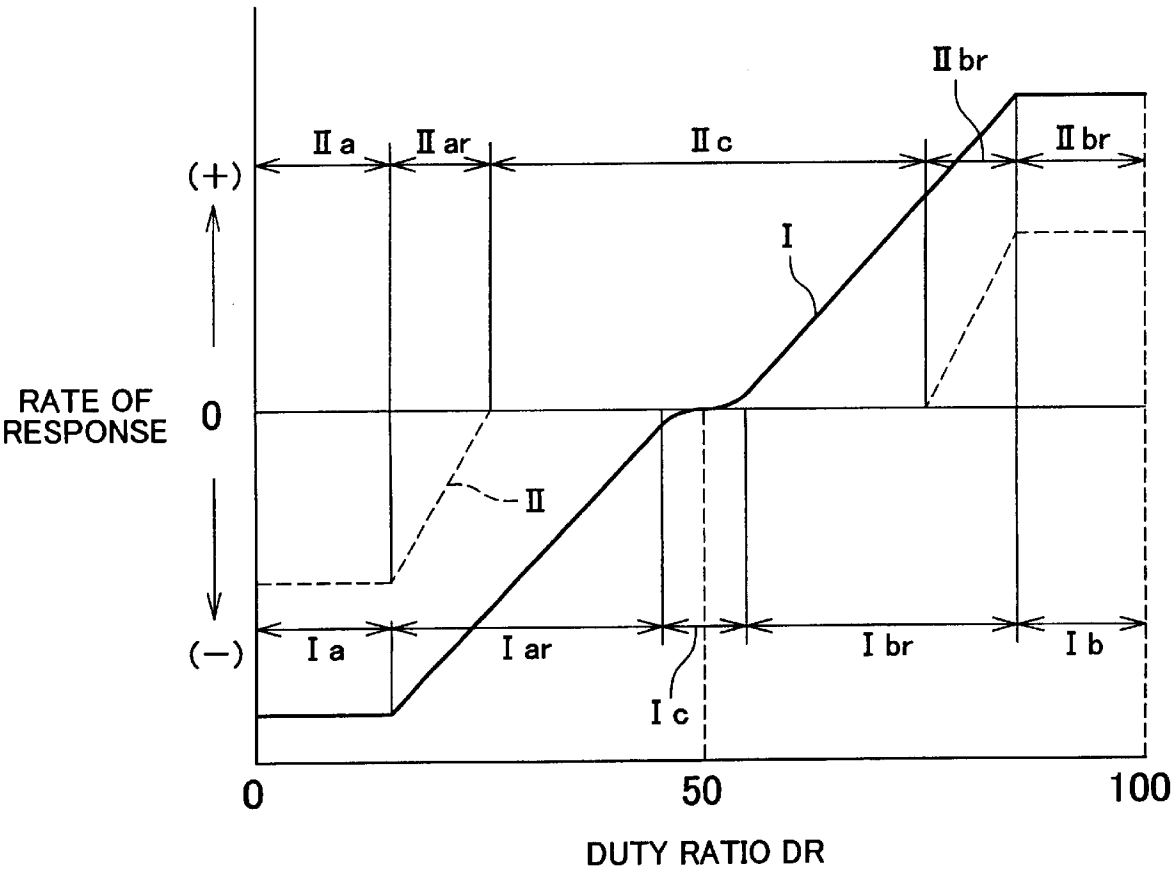
FIG. 4 is a graph illustrating the overall relationship between the driving signal duty ratio and the valve timing change responsiveness of the variable valve timing mechanism shown in FIGS. 2 and 3.

FIG. 4 is a view showing one example of the relationship between the driving pulse duty ratio of the OCV 25 and the rate of change (i.e., response rate) of the valve timing by the variable valve timing mechanism 10.

In FIG. 4, the solid line I represents the response curve when the oil temperature is sufficiently high and the operating oil viscosity has become a relatively low value during normal operation.

As can be seen from the solid line I in the figure, the response rate of the valve timing when the oil viscosity is low indicates an almost linear change in proportion to the duty ratio on both the plus (advance) side and the minus (retard) side of the duty ratio DR 50% marker (i.e., regions Iar and Ibr). Also, with the construction of the OCV 25, when the duty ratio DR approaches 0% and 100%, there are dead regions Ia and Ib in which the response rate does not change even if there is a change in the duty ratio. These dead regions Ia and Ib are regions in which the oil port 26*a* and oil port 26*b* of the OCV 25 are almost fully open and the change in the open area from the movement of the spool 26 is relatively little. Also, on curve I in FIG. 4, there is a small dead region Ic near the duty ratio DR 50% marker. This is a region where static friction resistance acts on the spool 26 of the OCV 25, keeping it from moving until the duty ratio DR increases and the spool 26 overcomes that static friction resistance. When the oil temperature is high, the friction resistance is low such that the spool begins to move with only the slightest increase in the duty ratio. This is why this dead region Ic is relatively narrow.

In contrast, the broken line II in FIG. 4 represents a response curve when the oil temperature is low and the operating oil viscosity is high.

When the operating oil viscosity is high, the static friction resistance increases and the dead region IIc near the duty ratio DR 50% marker becomes quite large compared to when the oil temperature is high (Ic). Also, the widths of IIa and IIb near the duty ratio DR 0% marker and the duty ratio DR 100% marker are substantially the same as when the oil temperature is high (i.e., regions Ia and Ib). In the regions between dead regions IIa and IIb and IIc (i.e., regions IIar and IIbr), the response sensitivity to the change in the duty ratio changes such that the widths of those sensitive regions IIar and IIbr become quite narrow compared to when the oil temperature is high (i.e., regions Iar and Ibr).

Figure 5A:
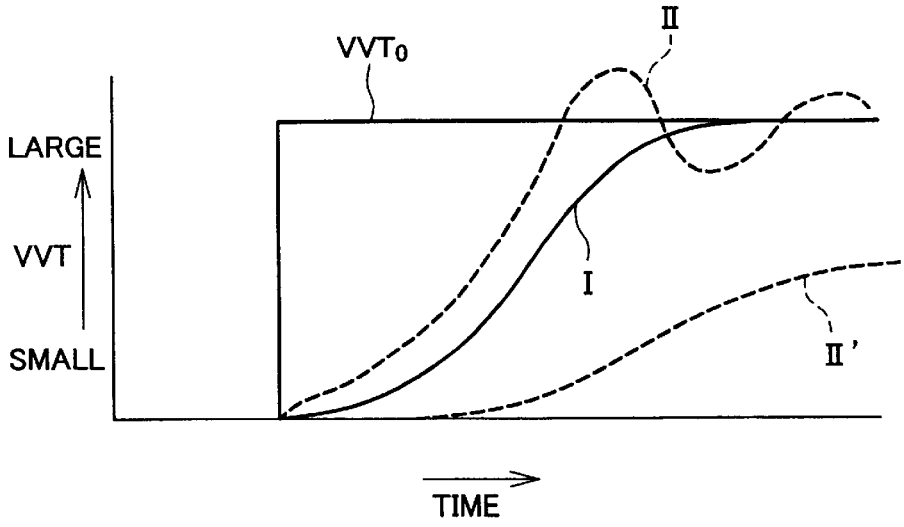
FIGS. 5A–5B are graphs illustrating a problem when conventional feedback control based on a difference between a target valve timing and an actual valve timing is performed when the oil temperature is low.
Figure 5B:
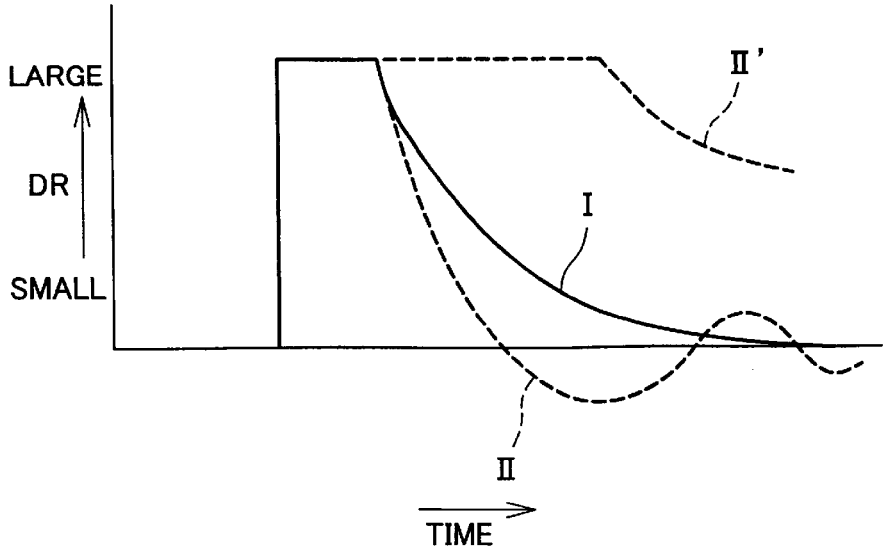

FIGS. 5A and 5B are representative views showing problems that arise when the PID control of the related art, which is based on the valve timing difference, is performed when the oil temperature is low.

FIG. 5A shows the change in the actual variable valve timing VVT when the target valve timing VVT0 has made a step-like change (advance). FIG. 5B shows the change in the driving duty ratio DR of the OCV 25 also when the target valve timing VVT0 has made a step-like change (advance). In FIGS. 5A and 5B, the solid line I represents the response when the oil temperature is high and the broken lines II and II' represent the response when the oil temperature is low.

As shown in the figures, when the target valve timing VVT0 has made a step-like change when the oil temperature is high (solid line I), the duty ratio DR of the OCV 25 increases and then smoothly decreases, and the actual valve timing VVT also changes so as to smoothly converge with the target valve timing VVT0 in a short amount of time (solid line I in FIGS. 5A and 5B).

However, when the oil temperature is low and the operating oil viscosity is high, as shown by the broken lines in FIGS. 5A and 5B, hunting occurs (broken line II) and responsiveness drastically decreases (broken line II').

The hunting shown by the broken line II occurs because the regions sensitive to the rate of change in the VVT with respect to the change in the duty ratio when the temperature is low (i.e., regions IIar and IIbr in FIG. 4) are narrow, and moreover, because that sensitivity itself is changing. Also, hunting occurs when the gain of the feedback control is comparatively large and the control is performed in these sensitive regions (i.e., regions IIar and IIbr) and in the dead regions (i.e., regions IIa and IIb) near the duty ratio DR 0% marker and the duty ratio DR 100% marker. In addition, the significant delay in response shown by the broken line II' occurs when the feedback control gain is comparatively small and the control is performed in a range that includes the dead region (i.e., region IIc in FIG. 4) near the neutral position (i.e., near the duty ratio 50% marker).

In this way, although excellent control can be performed when the engine has sufficiently warmed up such that the oil temperature has risen, if the feedback control is being performed on the valve operating characteristic based on the difference between the target value and the actual value, the control becomes unstable and the responsiveness decreases significantly when the oil temperature is low and the operating oil viscosity is high, such as during a cold start of the engine.

As described above, the reason that the problems with respect to stability and responsiveness in the feedback control arise when the operating oil viscosity is high is because of the difference in the responsiveness to the duty ratio DR when the operating oil viscosity is low (curve I) and when it is high (curve II), as shown by the response curves in FIG. 4. In other words, the problems with respect to stability and responsiveness arise because the rate of response to a change in the valve operating characteristic differs depending on the operating oil viscosity, even if the values of the duty ratios DR of the driving signals supplied to the OCV 25 are identical. Therefore, the above-mentioned problems are unable to be solved by performing control to change the size of the duty ratio of the driving signal according to the difference between the target value and the actual value of the valve operating characteristic.

Therefore, the invention solves these problems not by changing the size of the duty ratio DR according to that difference, but by fixing the value of the duty ratio DR at a comparatively large value (i.e. to a value sufficient to reliably change the valve operating characteristic, e.g., to 0% or 100%), and controlling the time for which a signal of this size is maintained, as will be explained below.

Figure 6A:
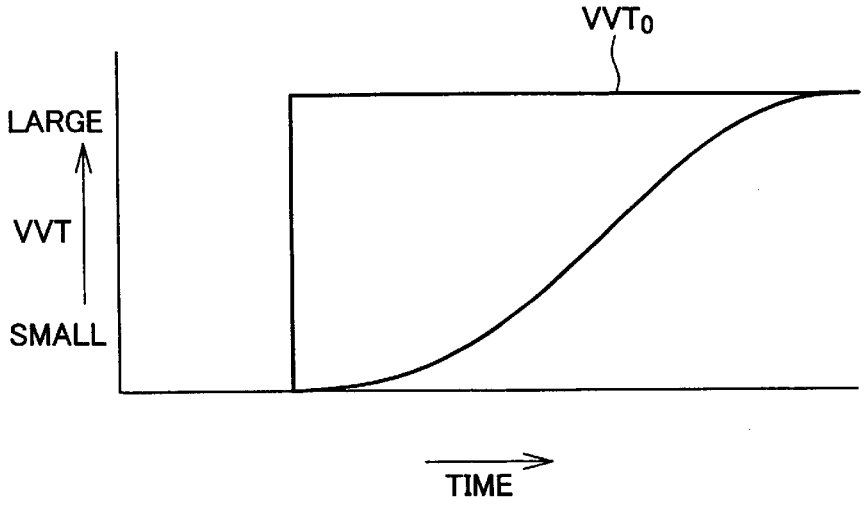
FIGS. 6A–6B are graphs similar to that of FIGS. 5A–5B, illustrating a fundamental principle of valve operating characteristic control performed by the valve control apparatus according to the invention.
Figure 6B:
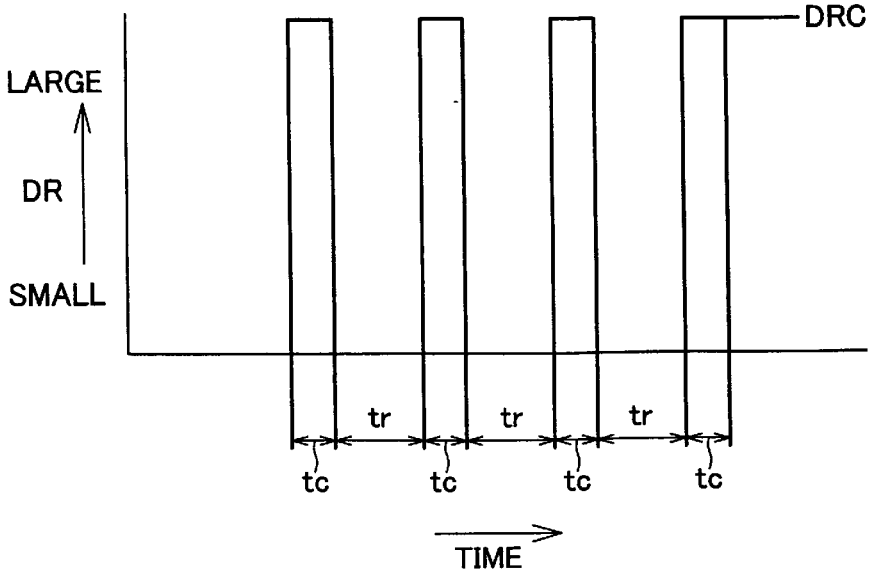

FIGS. 6A and 6B are views similar to those of FIGS. 5A and 5B, and illustrate the basic principle of the valve operating characteristic control according to this invention.

According to this invention, when the difference between the target value and the actual value of the valve operating characteristic is larger than a predetermined value, a forced driving operation is performed which repeats, at intervals of a predetermined rest time tr, an operation that keeps the duty ratio DR of the driving signal at a forced driving signal value DRC for a predetermined hold time tc, as shown in FIG. 6B, regardless of the amount of that difference between the target value and the actual value of the valve operating characteristic.

Here, the DRC (i.e., the forced driving signal value) is fixed in the example given in FIG. 6B. However, the DRC does not necessarily need to be a fixed. The DRC can be any value as long as it is a value which will reliably change the valve operating characteristic even when the operating oil viscosity is at its highest (or at its lowest). For example, with the broken line II in FIG. 4, the DRC may be a value in a range other than the dead region IIc near the neutral position (i.e., it may be within the region IIar or IIa if the difference is positive, and within the region IIbr or IIb if the difference is negative). In this exemplary embodiment, the hold time tc and the rest time tr are also set at fixed values.

In this way, by driving the actuator repeatedly for each fixed, comparatively short hold time tc with the duty ratio DRC, the amount of change in the valve operating characteristic is the same for each hold time tc. That is, by driving the actuator for only the hold time tc each time with the duty ratio DRC, it is possible to change the valve operating characteristic by the same amount each time. In this way, because a uniform amount of change in the operating characteristic is able to be obtained by repeatedly performing the driving operation (hereinafter referred to as "inching") of this hold time tc, the total amount of change in the valve operating characteristic is able to be determined by the number of repetitions of inching. Therefore, in this invention, it is possible to accurately make the actual valve operating characteristic converge with the target valve operating characteristic without overshooting or undershooting, regardless of the operating oil viscosity, as shown in FIG. 6A.

Furthermore, the amount of change in the valve operating characteristic by inching once is determined by the hold time tc. Accordingly, because the number of times inching is performed until the actual operating characteristic matches the target operating characteristic can be controlled by adjusting the hold time tc according to the amount of the difference when control starts, it is possible to bring the actual operating characteristic to match the target operating characteristic in a short amount of time by setting each hold time tc long when the difference is large, for example. That is, the control responsiveness can be adjusted by adjusting the hold time tc.

It is preferable that the operating characteristic not change during the rest time tr while inching. Accordingly, it is preferable that the duty ratio DR be set to a value in the dead region IIc around the central position (e.g., a duty ratio of 50%) in FIG. 4 during the rest time tr each time after inching is performed. If the duty ratio of the driving signal is set to 50%, for example, at the start of the rest time tr after inching is performed, the spool 26 of the OCV 25 will start to move toward the neutral position and will reach the neutral position after a certain amount of time has elapsed. Therefore, if the rest time tr is set somewhat shorter, the next inching starts to be performed before the spool 26 has returned to the neutral position. Accordingly, controlling the rest time tr enables the spool position at the start of inching each time to be controlled, thereby increasing the degree of freedom of control.

As described above, according to the invention, fundamentally, the valve operating characteristic is able to be made to converge with the target valve operating characteristic by repeatedly performing the inching operation. That is, in contrast to the feedback control of the related art, which controls the responsiveness to changes in operating characteristics by changing the value of the duty ratio DR of the driving signal, this invention sets the value of the duty ratio DR to DRC and controls the responsiveness to changes in operating characteristics not by controlling the value of that DRC according to the difference, but by using the hold time tc and the rest time rf.

Next, several exemplary embodiments in which the valve operating characteristic control described above has been applied to the variable valve timing control shown in FIGS. 1 through 3 will now be described in detail.

(1) First Embodiment

Figure 7:
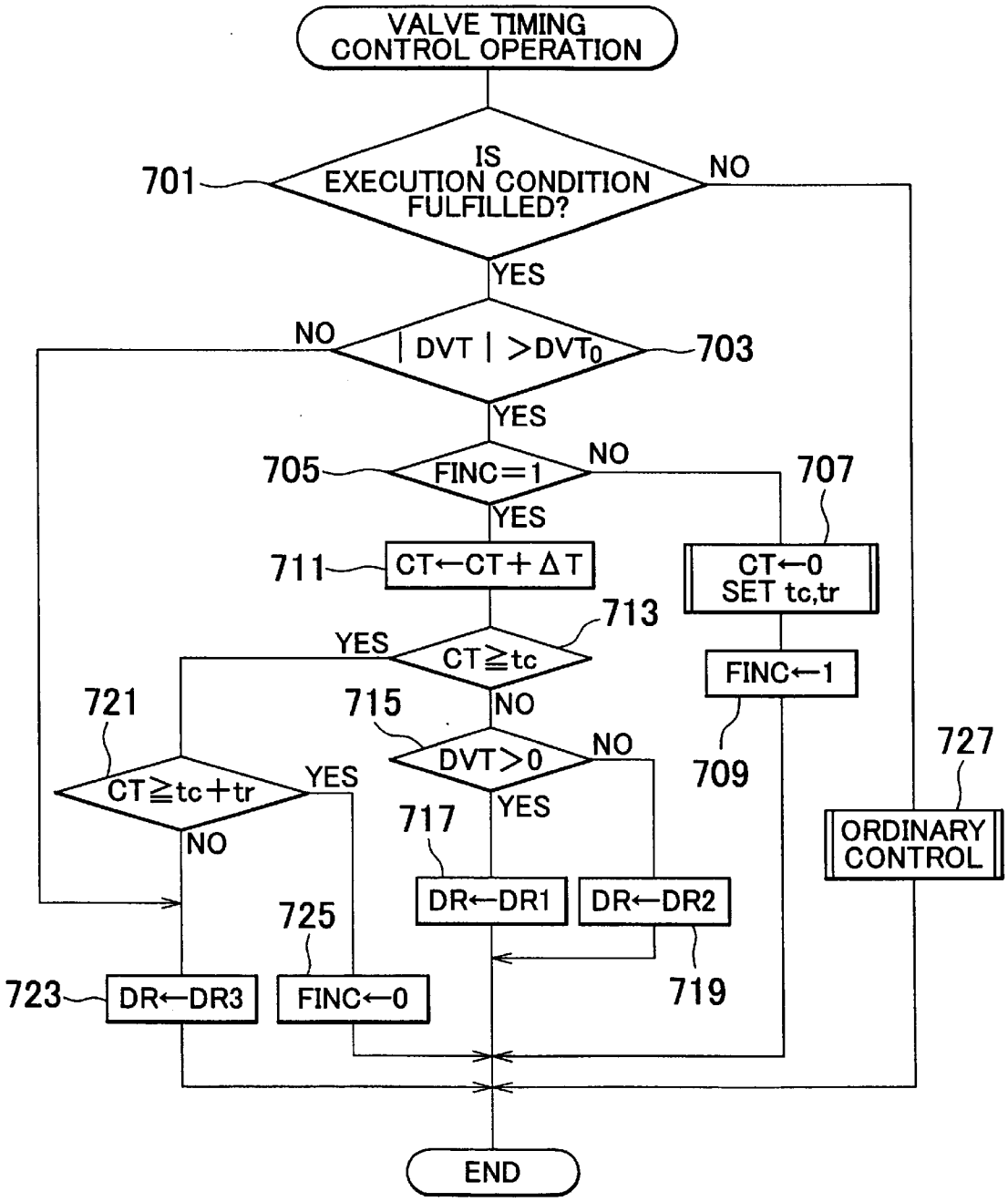
FIG. 7 is a flowchart illustrating a valve operating characteristic control operation performed by the valve control apparatus according to a first exemplary embodiment of the invention.

FIG. 7 is a flowchart showing an operation to control the valve timing according to a first exemplary embodiment of the invention. This operation is performed according to a routine that is executed by the ECU 30 at predetermined intervals of time.

In the operation shown in FIG. 7, it is first determined in step 701 whether a condition for executing the control by inching, to be described later, has been fulfilled. If the condition has not been fulfilled, the process proceeds to step 727, in which normal control (e.g., PID control based on the difference between the target value and the actual value or the like) is executed. That is, when it has been determined in step 701 that the predetermined condition has not been fulfilled (i.e., when a predetermined prohibiting condition is fulfilled) the variable valve timing control by inching in step 703 onward is not executed. The condition for executing the inching control, which is determined in step 701, will be described later.

When the condition has been fulfilled in step 701, the process proceeds on to step 703, in which it is determined whether the absolute value of the difference DVT (DVT= target valve timing−actual target valve timing) between the current target valve timing and the actual valve timing exceeds a predetermined allowable difference $DVT_0$. The target valve timing is set according to the engine operating state (e.g., the intake air amount and the engine speed) by a valve timing setting operation executed by another ECU 30. The difference DVT is calculated as the difference between the target valve timing and the actual valve timing calculated from a separate cam phase.

Further, according to this exemplary embodiment, the allowable difference $DVT_0$ is set to the size of the error between the target valve timing allowable for the engine operation and the actual valve timing. That is, when the absolute value of the actual difference DVT is less than the allowable difference $DVT_0$ in step 703, it is thought that the valve timing has actually converged with the target valve timing. Therefore, when $DVT \leqq DVT_0$ in step 703, the process proceeds to step 723, where the duty ratio DR of the driving signal of the OCV 25 is set to a holding duty (i.e., rest value) DR3. This holding duty DR3 is a neutral state duty ratio to maintain the current valve timing. The holding duty DR3 is a value within the Ic in the example in FIG. 4, and is set to a duty ratio of 50% in this exemplary embodiment. As a result, when the valve timing has converged on the target value, it is maintained there.

When the absolute value of the difference DVT is larger than the allowable difference $DVT_0$ in step 703, the process then proceeds on to step 705, in which it is determined whether the value of an inching operation execution flag FINC is set to 1 (i.e., executed). The flag inching operation execution flag FINC is a flag indicating whether inching is being currently executed. If inching is not currently being executed (i.e., inching operation execution flag FINC≠1), i.e., when the inching operation has not yet been executed up to this point or when the last inching cycle has just ended, the process proceeds to step 707, in which the value of a inching time counter CT, to be described later, is reset to 0 and the hold time tc and the rest time tr are set according to the size of the absolute value of the current difference DVT. In this embodiment, the oil temperature and the engine speed and the like of an actual engine were changed and tests were performed, and the relationship between the difference DVT and the hold time tc and rest time tr, in which the optimum response is able to be obtained under each of the conditions, was obtained and stored in the ROM of the ECU 30 beforehand. In step 707, the hold time tc and the rest time tr are determined from this data, based on the difference DVT. After determining each hold time tc and rest time tr, the process proceeds on to step 709, in which the value of the inching operation execution flag FINC is set to 1 (i.e., executed), after which the current operation ends.

When the operation is performed the next time, step 711, which is the next step after step 705, is executed because the value of the inching operation execution flag FINC has already been set, and the value of the inching time counter CT increases by a value ΔT equivalent to the execution interval of the operation. As a result, the value of the inching time counter CT indicates the time since inching operation execution flag FINC=1 in step 705, i.e., the time that has elapsed since inching started.

Next, in step 713, it is determined whether the inching time counter CT since inching started has reached the hold time tc set in step 707. If the inching time counter CT has not reached the hold time tc, the duty ratio DR is set to a preset forced driving signal value DR1 or DR2, depending on whether the difference DVT is positive or negative (step 715). The DR1 is a value (DR1) that will reliably change the valve timing in the positive direction, and the forced driving signal value DR2 is a value (DR2) that will reliably change the valve timing in the negative direction. The forced driving signal values DR1 and DR2 are at least values in a region other than the dead region IIc of the OCV 25 shown in FIG. 4, which are as close as possible to 100% and 0%. In this exemplary embodiment, for example, the forced driving signal value DR1 is set to 100% and the forced driving signal value DR2 is set to 0%.

That is, the duty ratio DR of the driving signal from the time inching starts until the hold time tc has elapsed is maintained at a forced driving signal value (i.e., forced driving signal value DR1 or DR2) by the operations in steps 713 through 717.

When the hold time tc after inching has started has elapsed in step 713, on the other hand, the process proceeds on to step 721, in which it is determined whether the rest time tr, in addition to the hold time tc, has elapsed. If the hold time tc has elapsed but the hold time tc has not yet elapsed in step 721, the process proceeds on to step 723, in which the duty ratio DR is set to the holding duty ratio (rest value) holding duty DR3 (50% in this exemplary embodiment). As a result, in the inching operation, the duty ratio DR is first maintained at the forced driving signal value (i.e., forced driving signal value DR1 or DR2) during the hold time tc. Then after the hold time tc has elapsed, the duty ratio DR is maintained at the holding duty ratio (rest value) holding duty DR3 during the rest time tr.

Also, when the rest time tr has elapsed in step 721, the value of the inching operation execution flag FINC is set to 0 is step 725. As a result, when the operation is performed the next time, steps 707 and 709, which follow step 705, are executed and the inching operation is repeated until the valve timing converges on the target value in step 703.

As described above, according to this exemplary embodiment, it is possible to effectively maintain the responsiveness of the valve timing control without losing stability in the control even when the oil temperature is low and the oil viscosity is high, by repeating the inching operation.

Next, the condition for executing the inching control, which is determined in step 701 in FIG. 7, will be described.

The following are examples of conditions to be determined as the conditions to execute inching control.

(a) size of the valve timing difference DVT between the target value and the actual value (b) oil temperature (c) whether learning of the holding duty ratio (rest value) is finished Because inching is normally done by driving with a duty ratio DR that is comparatively large so as to ensure that the valve timing will change, there is a possibility of overshooting if inching is performed with a difference DVT that is too small. This is why the difference DVT in condition (a) above is determined. Therefore, when the size of the difference DVT has decreased somewhat, inching may be prohibited even if the size of that difference DVT is not equal to, or less than, the allowable difference $DVT_0$, and ordinary feedback control may be performed.

The foregoing condition (b) is to prevent any problems from occurring even if ordinary feedback control is performed when the oil temperature is high and the operating oil viscosity is sufficiently low. With inching, the OCV 25 switches at short intervals between a fully open state (i.e., DR is 0% or 100%) and a fully closed state (i.e., DR is 50%). As a result, wear and the like of the members on the OCV 25 may increase when inching is performed for an extended period of time. Therefore, when the oil temperature (or engine coolant temperature) is equal to, or greater than, a predetermined value, inching may be prohibited to inhibit the OCV 25 from becoming less reliable.

Further, the foregoing condition (c) is to inhibit erroneous control. With inching, it is necessary to maintain the duty ratio DR at a rest value during the predetermined rest time tr after the duty radio has been maintained at the signal value for forced driving. On the other hand, the characteristics of the OCV 25 may change gradually with use over an extended period of time. Ordinarily, the ECU 30 detects the dead region (i.e., region Ic in FIG. 4) in which there is no change in the valve timing even if there is a change in the duty ratio DR while driving. The ECU 30 then learns the holding duty value that corrects the neutral position according to the change in the dead region. However, when inching is performed in a state in which the results of this holding duty value learning have been lost due to having been cleared by the battery being disconnected or the like, the valve timing changes during the rest time tr as well, and an overshoot may result because inching was performed. Therefore, for example, it may be determined in step 701 whether learning of the rest value has been performed up to the current point. If learning has not been performed at all, the valve timing control by inching may be prohibited.

According to the exemplary embodiment, it is determined in step 701 whether any one or more of the foregoing conditions (a) through (c) has been fulfilled. If any one of the conditions has been fulfilled, inching control is prohibited.

(2) Second Embodiment

Next, a second exemplary embodiment of the invention will be described. According to this exemplary embodiment, the hold time tc and the rest time tr are not set each time inching is performed, but instead are set to a predetermined fixed value. Also, after each time that inching is performed, the valve timing amount that changed by that inching is calculated and compared with the current valve timing difference. Based on this comparison, it is then determined whether the valve timing will change so as to exceed the target value (i.e., overshoot) if inching is performed with the same hold time tc the next time. If there is a possibility of overshooting the target value, inching is not performed the next time. Instead, the conventional feedback control is performed.

When each hold time tc and rest time tr is fixed and inching is performed, overshooting in which the valve timing changes to exceed the target value may occur with inching just before the actual valve timing converges on the target value. If this happens, convergence of the valve timing on the target value is delayed. In particular, when there is an overshoot in the advance direction, the valve timing of the intake valve advances beyond the optimal value and the overlap of the open valve period of the intake valve with the open valve period of the exhaust valve (i.e., valve overlap) increases, which may result in a deterioration of combustion in the engine at times such as when the engine is cold. According to this exemplary embodiment, when there is a possibility of overshooting occurring if the next inching is performed, as described above, inching is stopped and ordinary feedback control is performed. As a result, it is possible to minimize the deterioration of combustion due to overshooting.

Figure 8:
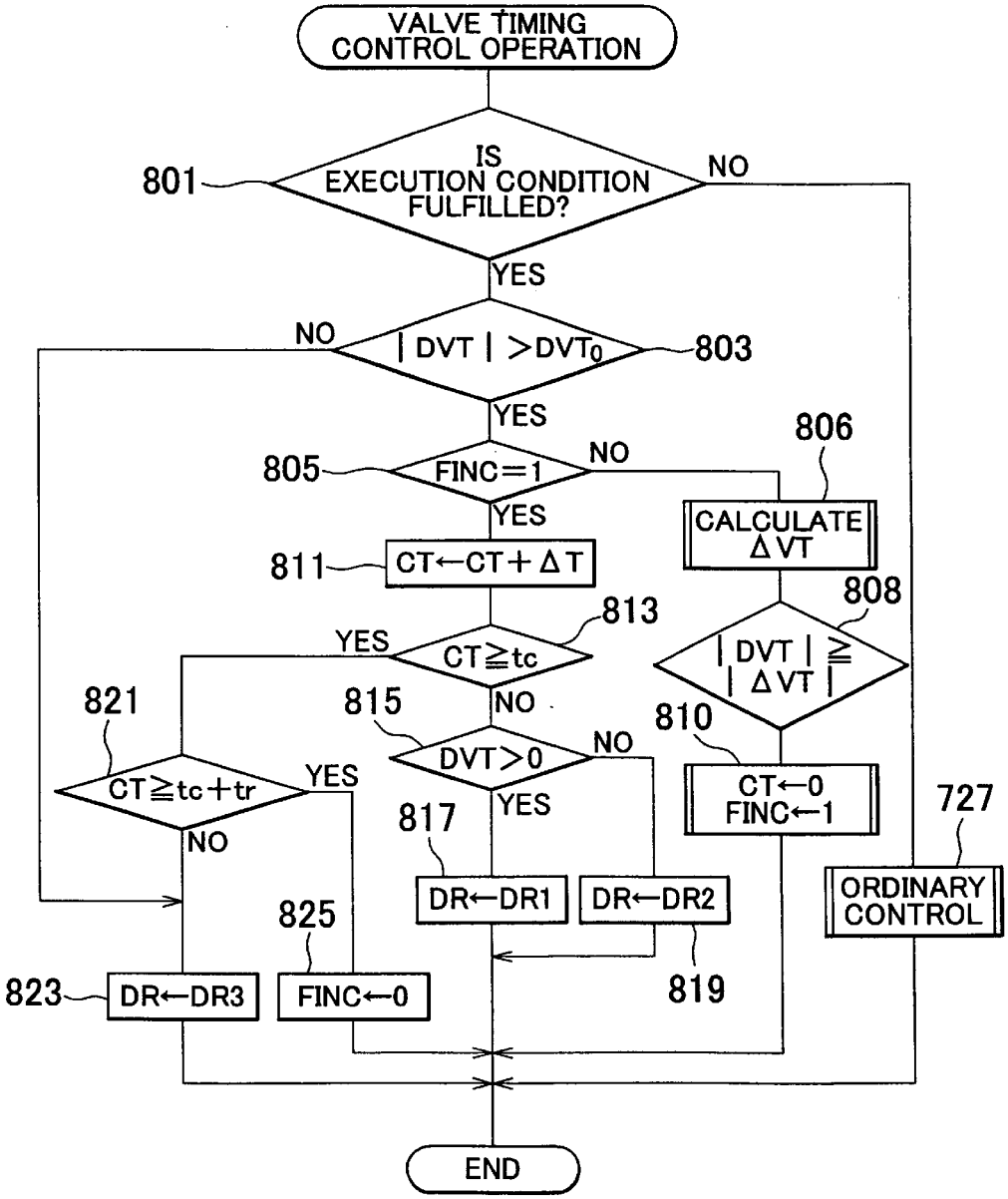
FIG. 8 is a flowchart illustrating a valve operating characteristic control operation performed by the valve control apparatus according to a second exemplary embodiment of the invention.

FIG. 8 is a flowchart illustrating a valve timing control operation according to the second exemplary embodiment.

This operation is performed as a routine that is executed by the ECU 30 at predetermined intervals of time.

The operation in FIG. 8 differs from that of the first exemplary embodiment in that steps 806, 808, and 810 are executed instead of steps 707 and 709 in the operation shown in FIG. 7. The difference is that after inching ends and before the next inching starts (i.e., FINC≠1) in step 805, an amount of change ΔVT in the valve timing from the start of the last inching until the current point in time is calculated in step 806.

Then, in step 808, the absolute value of the current valve timing difference DVT is compared with the absolute value of the amount of change ΔVT in the valve timing from the last inching.

Here, when |DVT|<|ΔVT|, i.e., when inching is performed one more time, the valve timing overshoots, exceeding the target value. Therefore, inching is not performed again. Instead, the process proceeds on to step 827, where the conventional feedback control is performed. As a result, it is possible to reliably inhibit deterioration of combustion due to overshooting.

On the other hand, when |DVT|≧|ΔVT| in step 808, the inching time counter CT is reset to 0 in step 810, and the value of the inching operation execution flag FINC is set to 1. As a result, when the operation is next performed, inching according to steps 805 through 823 is executed. In this case, the hold time tc and the rest time tr in steps 813 and 821 are fixed values, regardless of the valve timing difference.

(3) Third Embodiment

Next, a third exemplary embodiment of the invention will be described. In the first and second exemplary embodiments, the hold time tc of the forced driving signal value during the inching operation is fixed, and the valve timing is made to converge on the target value by repeating the inching operation for a set length of time.

In contrast, according to the third exemplary embodiment, the duty ratio DR is first maintained at the forced driving signal value for only a fixed basic time, after which the amount of change in the valve timing during this basic time is calculated. The hold time tc of the forced driving signal value necessary for making the valve timing converge on the target value with the next inching is calculated based on this amount of change and the current difference.

Figures 9A, 9B:
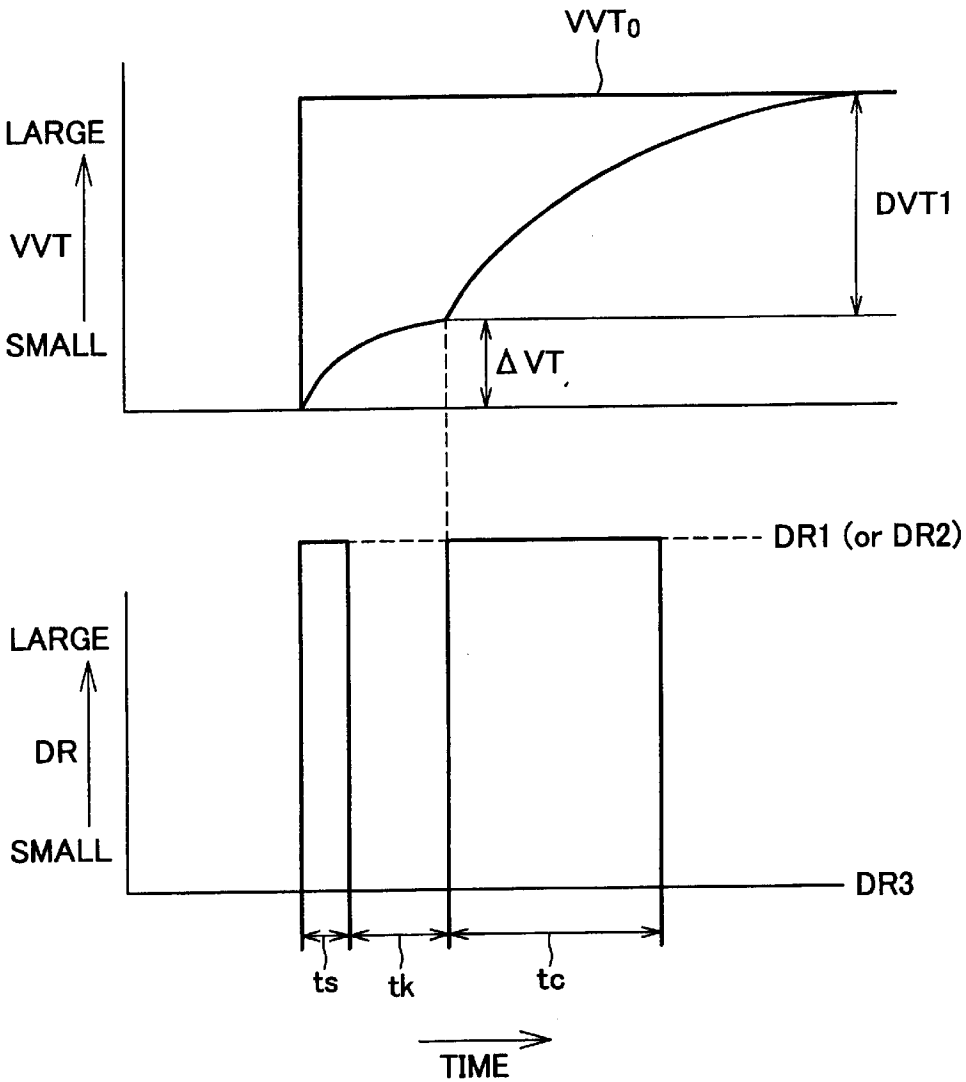
FIGS. 9A–9B are graphs illustrating the control principle of a valve operating control characteristic control operation performed by the valve control apparatus according to a third exemplary embodiment of the invention.

FIGS. 9A and 9B, which are graphs similar to those in FIGS. 5A and 5B, illustrate the principle of the third exemplary embodiment by showing the change in the duty ratio DR and the response to change in the valve timing.

According to this third exemplary embodiment, when the target valve timing changes, the duty ratio DR is first maintained at the forced driving signal value DR1 or DR2, depending on the sign of the difference, for the basic time ts which is relatively short. Then, the duty ratio DR is maintained at the holding duty DR3 for a fixed confirmation time tk. The confirmation time tk is the time necessary for the change in the valve timing, which started by maintaining the duty ratio at the forced driving signal value for the basic time ts, to end. The basic time ts and the confirmation time tk differ depending on the type and size of the variable valve timing mechanism OCV, so they are determined beforehand by experimentation or the like using an actual device.

In this exemplary embodiment, when the confirmation time tk elapses, the amount of change ΔVT in the valve timing from the start of the basic time ts is calculated. Accordingly, it is evident that the valve timing changes by the ΔVT when the duty ratio DR is maintained at the forced driving signal value during the basic time ts with a conditions such as the current oil temperature (viscosity).

It is understood that the amount of change in the valve timing is substantially proportional to the hold time that the duty ratio DR is maintained at the forced driving signal value. Accordingly, if the difference between the target valve timing and the actual valve timing when the confirmation time tk elapses is made DVT1, the hold time tc of the forced driving signal value necessary to change the valve timing the amount of this difference DVT1 so that it converges on the target value is calculated according to the following expression.

$$tc=ts\times DVT1/\Delta VT$$

In this exemplary embodiment, by maintaining the duty ratio at the forced driving signal value DR1 or DR2 for only the hold time tc after the confirmation time tk has elapsed, the valve timing is made to converge on the target valve timing with only one inching, so inching does not have to be repeated (see FIGS. 9A and 9B). Therefore, it is possible to improve the responsiveness in the control without losing control stability when the oil temperature is low.

Figure 10:
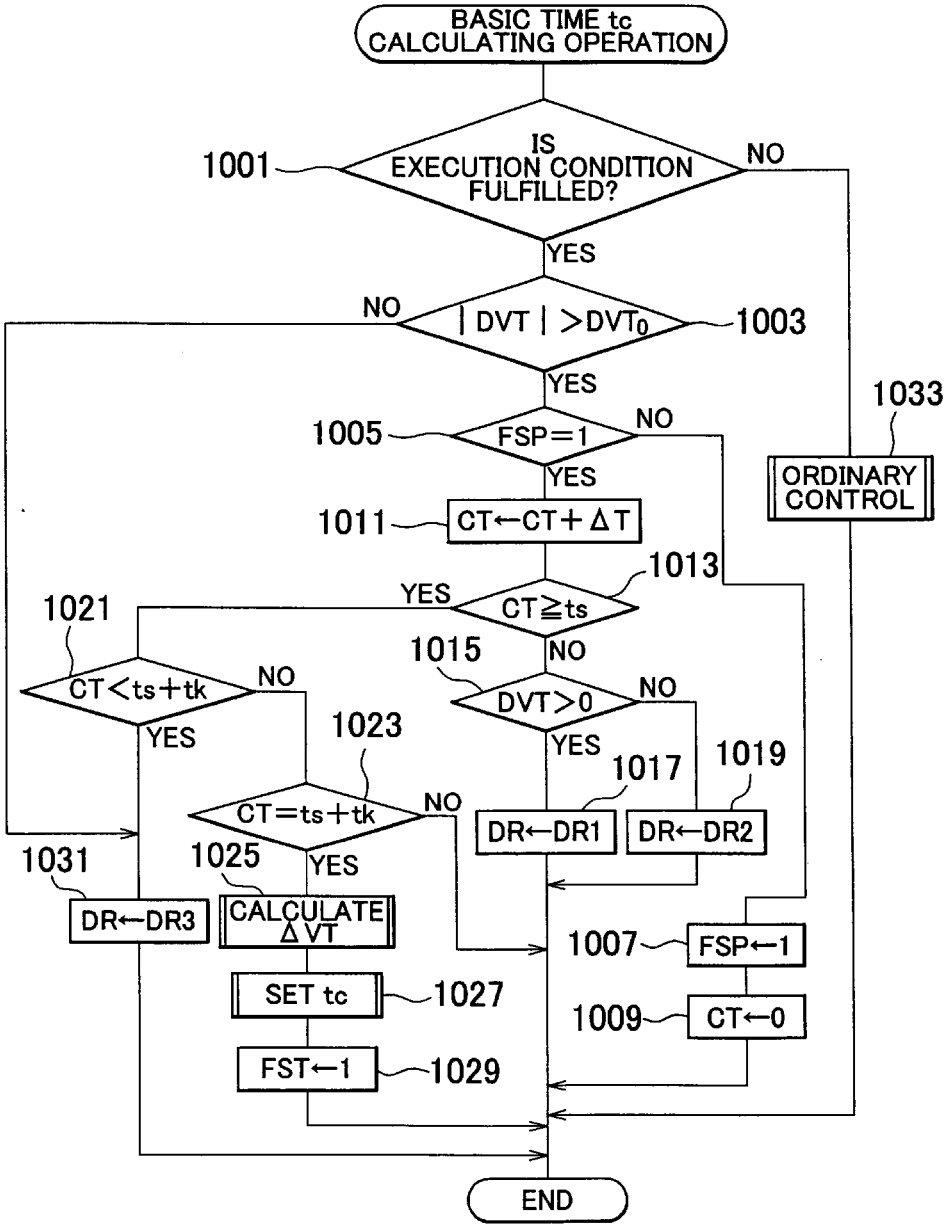
FIG. 10 is a view illustrating the valve operating control characteristic control operation performed by the valve control apparatus according to the third exemplary embodiment of the invention.
Figure 11:
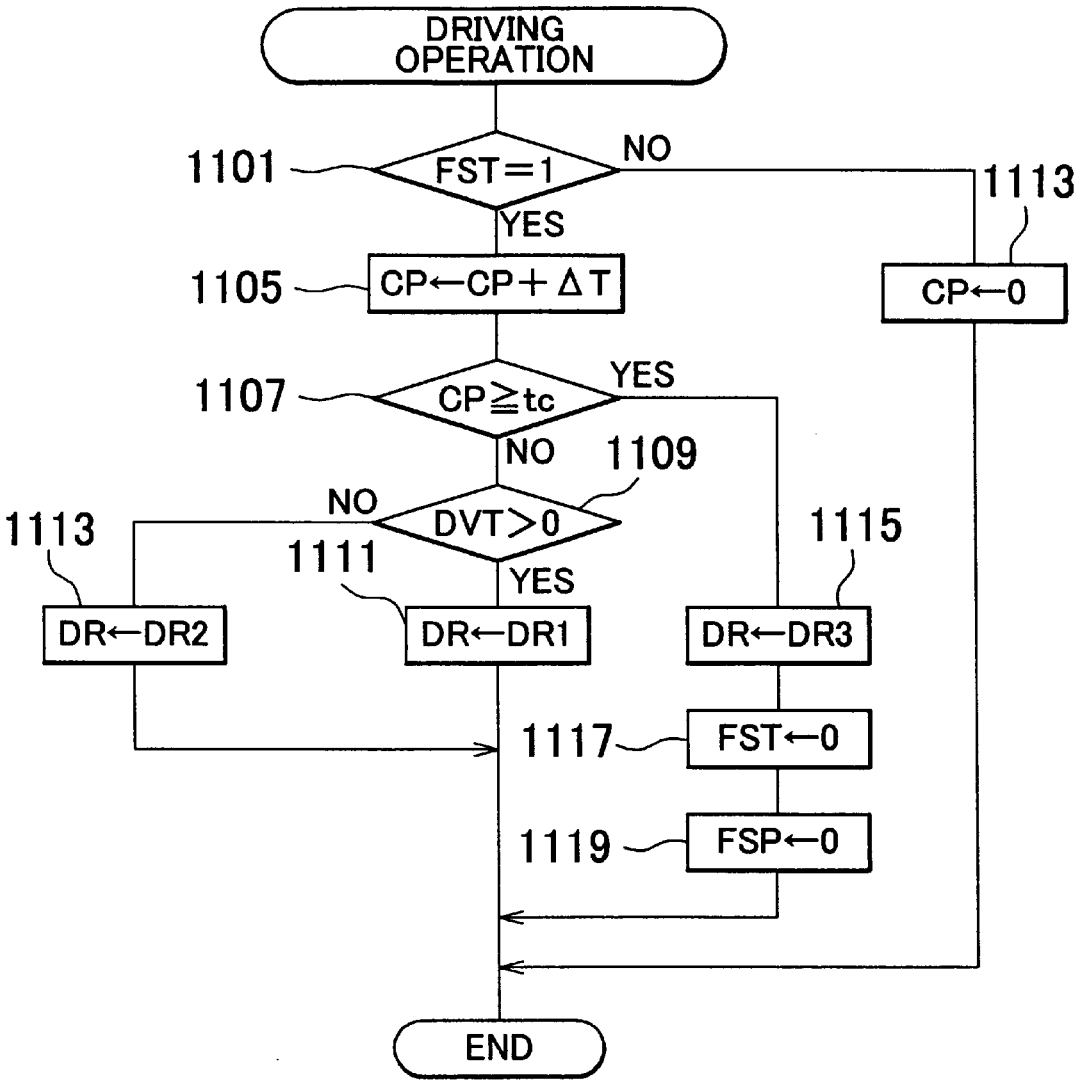
FIG. 11 is a flowchart illustrating another valve operating control characteristic control operation performed by the valve control apparatus according to the third exemplary embodiment of the invention.

FIG. 10 and FIG. 11 are flowcharts illustrating in detail the valve timing control operation according to the third exemplary embodiment. The operations in each of the figures are carried out separately by the ECU 30. The operation shown in FIG. 10 is a hold time tc calculating operation, in which the hold time tc necessary after a valve timing change when the duty ratio was maintained at the forced driving signal value for the basic time ts is calculated. The operation shown in FIG. 11 is a driving operation that maintains the duty ratio DR at the forced driving signal value for the hold time tc calculated by the operation in FIG. 10.

First, in the operation shown in FIG. 10, it is determined in step 1001 whether a condition for executing the current forced driving operation has been fulfilled. This condition is the same as that in the embodiments shown in FIGS. 7 and 8. Also, when it is determined in step 1001 that the condition for executing the forced driving operation has not been fulfilled, the process proceeds on to step 1033, in which ordinary feedback control is executed and the operation ends.

When the condition has been fulfilled in step 1001, on the other hand, it is next determined in step 1003 whether the current valve timing difference DVT exceeds the allowable difference $DVT_0$. When the difference DVT is within the allowable difference $DVT_0$, the process proceeds on to step 1031, where the duty ratio DR is set to the holding duty (rest value) DR3 (50% in this exemplary embodiment) and the operation ends. That is, when the current valve timing difference DVT is equal to, or less than, the allowable difference $DVT_0$, the forced driving operation is not performed.

When it has been determined in step 1003 that $|DVT|>DVT_0$, the process proceeds on the step 1005, where it is determined whether a value of a flag FSP, which indicates whether the operation of maintaining the duty ratio DR at the forced driving signal value during the basic time ts is being executed, is 1 (i.e., the operation is being executed). When FSP≠1 (i.e., the operation is not being executed), the flag FSP is set to 1 in step 1007 and the value of the inching time counter CT is reset to 0, after which this operation ends. Therefore, the value of the inching time counter CT is cleared at the same time the value of the flag FSP is set to 1 (i.e., the operation is executed).

When FSP=1 in step 1005, the value of the inching time counter CT is increased by ΔT in the next step, step 1011. This AT is the interval between executions of the operation.

Accordingly, the value of the inching time counter CT is a value which corresponds to the time that has elapsed from when the flag FSP was set to 1 in step 1007.

In step 1013, it is determined whether the value of the current inching time counter CT has reached a predetermined value ts, i.e., whether the current basic time ts has elapsed. If the basic time ts has not elapsed, the duty ratio DR is maintained at the forced driving signal value DR1 or DR2, depending on whether the difference from the target valve timing is positive or negative. Also, if it is determined in step 1013 that the basic time ts has elapsed, an operation is then performed in steps 1021 and 1031 which maintains the duty ratio DR at the holding duty DR3 until the value of the inching time counter CT reaches ts+tk (step 1021).

Further, when CT≧ts+tk is step 1021, the hold time tc required in steps 1025 through 1029 is calculated only when CT=ts+tk in step 1023. In any other case, the operation ends at that point.

In the operation from steps 1025 through 1029, the amount of change ΔVT in the valve timing is first calculated in step 1025 based on the current valve timing and the valve timing at the start of the operation (i.e., when step 1003 is executed). This amount of change ΔVT corresponds to the amount of change in the valve timing at the point when the confirmation time tk has elapsed (steps 1021 and 1023) after the duty ratio DR has been maintained at the forced driving signal value for the basic time ts (steps 1013 through 1019).

Next, the hold time tc necessary for making the valve timing converge on the target value is calculated in step 1027 as $$tc=ts\times(DVT-\Delta VT)/\Delta VT$$

based on the basic time ts and the amount of change ΔVT in the valve timing calculated as described above. (DVT−ΔVT) in the expression above corresponds to the difference (DVT1 in FIG. 9A) between the target valve timing and the actual valve timing at the point when the confirmation time tk has elapsed.

After the hold time tc is calculated in step 1027, the value of the flag FST, which indicates whether the hold time tc calculation is complete, is set to 1 (i.e., calculation complete) in step 1029, after which the operation ends.

Next, in the operation shown in FIG. 11, it is first determined in step 1101 whether the flag FST is set to 1. If FST≠1, the value of a counter CP, to be described later, is set to 0 in step 1103, after which the operation ends. That is, when the calculation of the hold time tc in the operation in FIG. 10 is not complete, the operations in step 1105 onward are not performed.

When the value of the flag FST has been set to 1 in step 1101, the value of the counter CP is increased by the operation execution interval ΔT in step 1105. Accordingly, the value of the counter CP becomes a value indicative of the time elapsed from the point when the hold time tc was calculated in FIG. 10, i.e., from the time when the confirmation time tk had elapsed.

Next, in step 1107, it is determined whether the value of the counter CP has reached the hold time tc calculated in step 1027 in FIG. 10. When the value of the counter CP has not reached the hold time tc, the duty ratio DR is set in steps 1109 and 1111 to either the forced driving signal value DR1 (100% in this exemplary embodiment) or the forced driving signal value DR2 (0% in this exemplary embodiment), depending on whether the valve timing difference DVT is positive or negative. That is, in steps 1109 and 1111, the duty ratio DR is maintained at the forced driving signal value from when FST=1 in step 1101 until the hold time tc calculated in the operation shown in FIG. 10 elapses.

When the hold time tc has elapsed in step 1107, the duty ratio DR is set in step 1115 to the holding duty DR3 (50% in this exemplary embodiment), and in steps 1117 and 1119, the flags FST and FSP are reset to 0. As a result, the operations shown in FIGS. 10 and 11 are performed again when the absolute value of the difference DVT exceeds the allowable difference $DVT_0$ (step 1003 in FIG. 10).

By performing the operations shown in FIGS. 10 and 11, valve timing control that is highly accurate and which has excellent responsiveness is able to be performed without losing stability even when the oil temperature is low.

In the foregoing exemplary embodiments, the invention is described using an example in which it has been applied to variable valve timing control. However, the invention is, of course, not limited to being applied to variable valve timing control, but may also be applied in the same manner to control another valve operating characteristic other than valve timing. For example, the invention may also be applied to control any one or a combination of valve operating characteristics such as valve lift amount and open valve period.

All the foregoing exemplary embodiments display a common effect of enabling the responsiveness in the valve operating characteristic control to be improved without losing stability, even when the engine is cold.

What is claimed is:

1. A valve control apparatus of an internal combustion engine, comprising:

an actuator that changes a valve operating characteristic, the actuator being actuated according to a value of a driving signal that is input thereto, wherein the valve operating characteristic includes at least one of a valve timing, a valve lift amount, and an open valve period;

a controller that performs a feedback operation detecting an operating characteristic parameter indicative of the valve operating characteristic and outputting the driving signal value according to a difference between an operating characteristic target value according to an operating condition of the engine and the detected parameter value to the actuator, and wherein the controller performs, instead of the feedback operation, a forced driving operation that repeats an operation to maintain the driving signal at a predetermined forced driving signal value for a predetermined hold time when the difference is greater than a predetermined value.

2. The valve control apparatus according to claim 1, wherein the controller detects the difference each time the predetermined hold time elapses, determines whether the detected difference is equal to, or greater than, a predetermined value, and terminates the forced driving operation when the difference is smaller than the predetermined value.

3. The valve control apparatus according to claim 1, wherein the controller maintains the driving signal at a rest value, which is a value smaller than the forced driving signal value, for a predetermined period each time after maintaining the driving signal at the forced driving signal value for the predetermined hold time during the forced driving operation.

4. The valve control apparatus according to claim 3, wherein the rest value of the driving signal is set to a value that will effectively not bring the actuator into operation.

5. The valve control apparatus according to claim 1, wherein the actuator comprises a hydraulic actuator that is driven by hydraulic pressure so as to change the valve operating characteristic.

6. The valve control apparatus according to claim 1, wherein the controller prohibits the forced driving operation when a predetermined operating condition of the engine has been fulfilled.

7. The valve control apparatus according to claim 1, wherein the controller detects a variation of the operating characteristic parameter during a first hold time in the forced driving operation, and determines the length of a second hold time after start of the forced driving operation based on the detected variation and the difference.

8. The valve control apparatus according to claim 1, wherein the forced driving signal value is a value which will result in the greatest operating speed of the actuator.

9. The valve control method according to claim 1, wherein the forced driving signal value is a value which will result in the greatest operating speed of the actuator.

10. A valve control method for an internal combustion engine having an actuator that changes a valve operating characteristic, the actuator being actuated according to a value of a driving signal that is input thereto, the valve operating characteristic including at least one of a valve timing, a valve lift amount, and an open valve period, the method comprising the steps of:

performing a feedback operation detecting an operating characteristic parameter indicative of the valve operating characteristic; and outputting the driving signal value according to a difference between an operating characteristic target value according to an operating condition of the engine and the detected parameter value to the actuator, and wherein a forced driving operation that repeats an operation to maintain the driving signal at a predetermined forced driving signal value for a predetermined hold time is performed instead of the feedback operation when the difference is greater than a predetermined value.

11. The valve control method according to claim 10, wherein the difference is detected each time the predetermined hold time elapses, whether the detected difference is equal to, or greater than, a predetermined value is determined, and the forced driving operation is terminated when the difference is smaller than the predetermined value.

12. The valve control method according to claim 10, wherein the driving signal is maintained at a rest value, which is a value smaller than the forced driving signal value, for a predetermined period each time after maintaining the driving signal at the forced driving signal value for the predetermined hold time during the forced driving operation.

13. The valve control method according to claim 12, wherein the rest value of the driving signal is set to a value that will effectively not bring the actuator into operation.

14. The valve control method according to claim 10, further comprising the steps of prohibiting the forced driving operation when a predetermined operating condition of the engine has been fulfilled.

15. The valve control method according to claim 10, wherein a variation of the operating characteristic parameter is detected during a first hold time in the forced driving operation, and the length of a second hold time after start of the forced driving operation is determined to be based on the detected variation and the difference.

16. A valve control apparatus of an internal combustion engine, comprising:

actuating means for changing the valve operating characteristic, the actuating means being actuated according to a value of a driving signal that is input thereto, wherein the valve operating characteristic includes at least one of a valve timing, a valve lift amount, and an open valve period; and drive controlling means that performs a feedback operation detecting an operating characteristic parameter indicative of the valve operating characteristic and outputting the driving signal value according to a difference between an operating characteristic target value according to an operating condition of the engine and the detected parameter value to the actuator, and wherein the drive controlling means performs, instead of the feedback operation, a forced driving operation that repeats an operation to maintain the driving signal at a predetermined forced driving signal value for a predetermined hold time when the difference is greater than a predetermined value.

* * * * *